United States Patent [19]

Janelid

[11] 4,072,352

[45] Feb. 7, 1978

[54] METHOD FOR MINING OF ROCK OR ORE ACCORDING TO THE BLOCK CAVING PRINCIPLE IN MASSIVE FORMATIONS

[76] Inventor: Erik Ingvar Janelid, Forsetevagen 18, Djursholm, Sweden

[21] Appl. No.: 605,465

[22] Filed: Aug. 18, 1975

[30] Foreign Application Priority Data

Aug. 20, 1974 Sweden ..... 7410589

[51] Int. Cl.[2] ..... E21C 41/00

[52] U.S. Cl. ..... 299/19; 299/18

[58] Field of Search ..... 299/18, 11, 19

[56] References Cited

U.S. PATENT DOCUMENTS

| | | | |
|---|---|---|---|
| 906,765 | 12/1908 | Anderson | 299/19 |
| 1,502,030 | 7/1924 | Goodney | 299/19 |
| 1,842,664 | 1/1932 | Elsing | 299/19 |
| 2,298,599 | 10/1942 | Smith | 299/19 |
| 2,536,869 | 1/1951 | Bucky | 299/19 |
| 3,897,107 | 7/1975 | Haglund | 299/19 |

FOREIGN PATENT DOCUMENTS

| | | | |
|---|---|---|---|
| 185,816 | 12/1966 | U.S.S.R. | 299/19 |

*Primary Examiner*—Ernest R. Purser
*Assistant Examiner*—William F. Pate III
*Attorney, Agent, or Firm*—Burns, Doane, Swecker & Mathis

[57] ABSTRACT

There is provided a method for extraction of rock or ore according to the block caving principle comprising driving, at several levels, principally straight, parallel and horizontal drifts into the lower part of a block, choosing the distance between the drifts at each level so that remaining supporting pillars will cover at least 40% of the block area, undercutting the block from the drifts in such a way that the drift openings toward the undercut area and the drift coverings will be arranged in steps, the drift openings being utilized as draw-points for the caving material and the number of drift levels being chosen with regard to desired horizontal distance along the direction of the drift between the draw-points at adjacent levels.

7 Claims, 5 Drawing Figures

METHOD FOR MINING OF ROCK OR ORE ACCORDING TO THE BLOCK CAVING PRINCIPLE IN MASSIVE FORMATIONS

The invention relates to a method for mining of rock or ore according to the block caving principle in massive formations.

Underground mining is in principle carried out either by drilling and blasting the ore or by undercutting a certain area, causing the ore to crack up and start caving, being further fragamented during gravity flow to the draw-points. A general name for the latter methods is block caving. This method is primarily used for extraction of large, low-strength orebodies, which for mining need to be divided into several blocks, and when the ore easily crack up into small pieces when the material moves toward the drawpoints. Limitations of the usefulness of block caving are resistance to fragmentation of the ore, required secondary blasting of boulders and practical problems with the arrangement of stable and safe workings under the block for loading out the ore.

The principle for preparing a block is to arrange a loading level with conical draw-points in the ore up to an undercuttng level, located about 10 meters above the loading level. The caving starts from the undercutting level. When ore is loaded out of the draw-points, new ore caves down from the block above.

In order to get an even draw of the caving block and thereby avoid ore losses and waste rock dilution it is important that the distance between the draw-points is not too long, particularly in relation to the size of the draw-point openings and the height of the block. Besides, loading should be rather evenly distributed between the various draw-points.

For loading, the caving properties and required secondary blasting are the substantial factors for dimensioning of the draw-point openings and for the loading method.

Under favourable conditions, block caving is a very efficient, low-cost mining method. However, for high strength ore with coarse fragmentation during caving and thereby a great number of boulders at the draw-point, the loading capacity decreases very rapidly unless both draw-openings and machines are big.

Big loaders require large draw openings and large haulage drifts, which also means that a smaller part of the ore remains as supporting pillars at the loading level, since the distance between the draw openings should not be too long. Thereby, extensive reinforcement work with roof bolting, steel supports, concrete etc. is required. Thus, a poor fragmentation of the ore generates two very difficult and costly problems, viz. secondary blasting of boulders and reinforcement of draw openings and haulage drifts.

Boulder blasting is carried out with known technique in and from the draw openings which is both expensive and difficult and, above all, very risky.

The knonw technique of block caving in large, massive orebodies is planned and used at e.g. Climax and Henderson, USA, and El Teniente and El Salvador, Chile.

For block caving in inclined orebodies of limited thickness an other technique for preparation and mining is used which is specifically distinct from the technique described above. One practical form of this known technique is described in the Swedish patent No. 364,339, and reference can be made to applications at the Creighton mine, Canada, and the Grace mine, USA.

Known block caving technique is further described e.g. in "Underground Mining Methods" worked out by AIME, USA.

One objective of the present invention is to improve the stability of draw-points and haulage drifts.

Another object is to facilitate the undercutting of blocks.

Another objective is to faciliatate secondary boulder blasting and removal of hangups.

Another objective is to make it possible to locate the draw-points close to each other, while maintaining large pillar area for support.

In the method mentioned in the preamble, the above objectives are fulfilled and the mentioned disadvantages are eliminated by driving substantially straight, parallel and horizontal drifts in several levels, into the lower part of a block with such a distance between the drifts of each level that resulting supporting pillars gets an area of at least 40% of the block area, undercutting the block from the drifts in such a way that the openings of the drifts towards the undercutting area and the coverings of the drifts toward the undercut area will be arranged substantially in steps, said drift openings being utilized as draw-points for the caving rock, the number of drift levels being chosen depending on desired horizontal distance between draw-points of adjacent drift levels. The pillar area may well be larger than 50%, preferably larger than 60%.

Here "covering" is defined as the layer of solid rock or ore, forming the roofs of the drifts.

The invention is further defined in the appended claims.

The invention is specifically suited for mining of large formations which must be mined in several separate blocks.

If the draw-points must be retreated far back due to weak rock in the drift opening area, a new draw-point loading level may be arranged under the previous levels with the draw-points of the new level located so that the distribution of loading points over the area of the block is evened out.

If the original draw-points are arranged in a vee-shaped plane, the draw-points of a new level should be located under the point of the "vee".

In order that the invention may be more clearly understood, reference is made to the description which follows and to the embodiment illustrated by way of example in the accompanying drawings in which.

Figure 1:
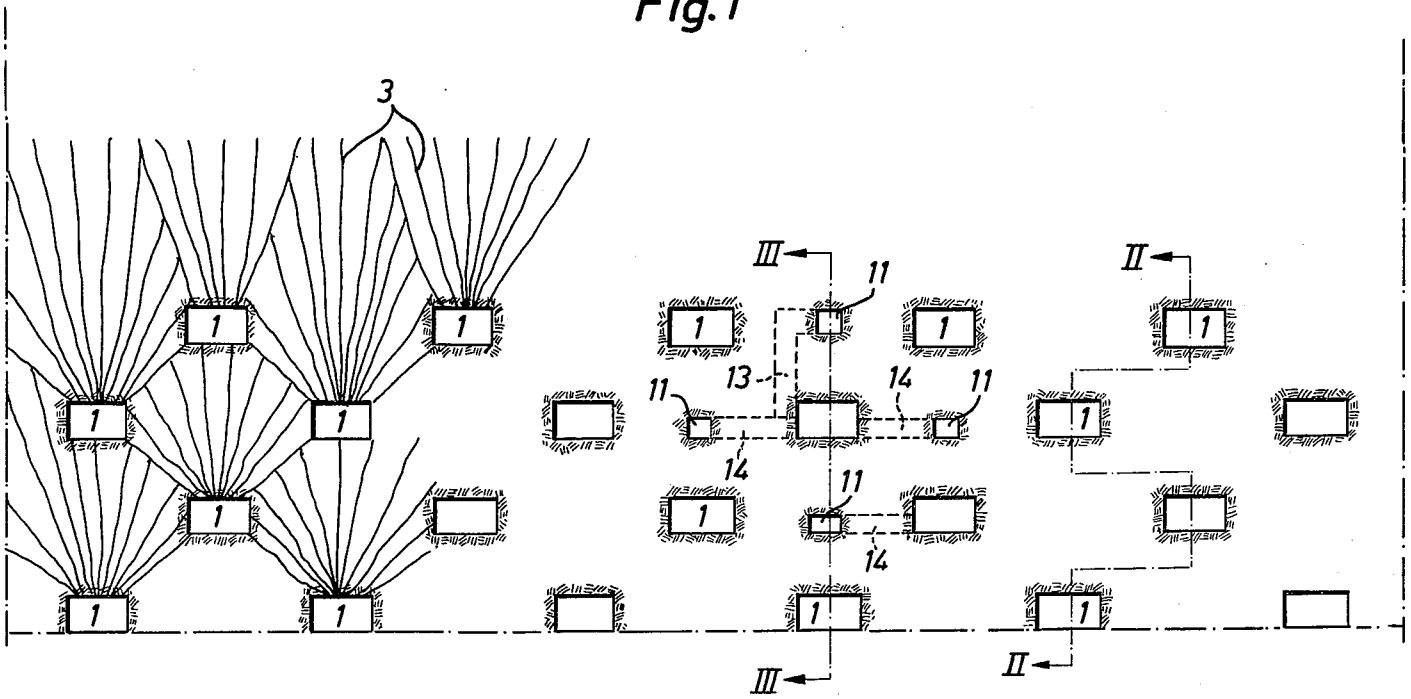
FIG. 1 shows a vertical section through a block to be mined.
Figure 2:
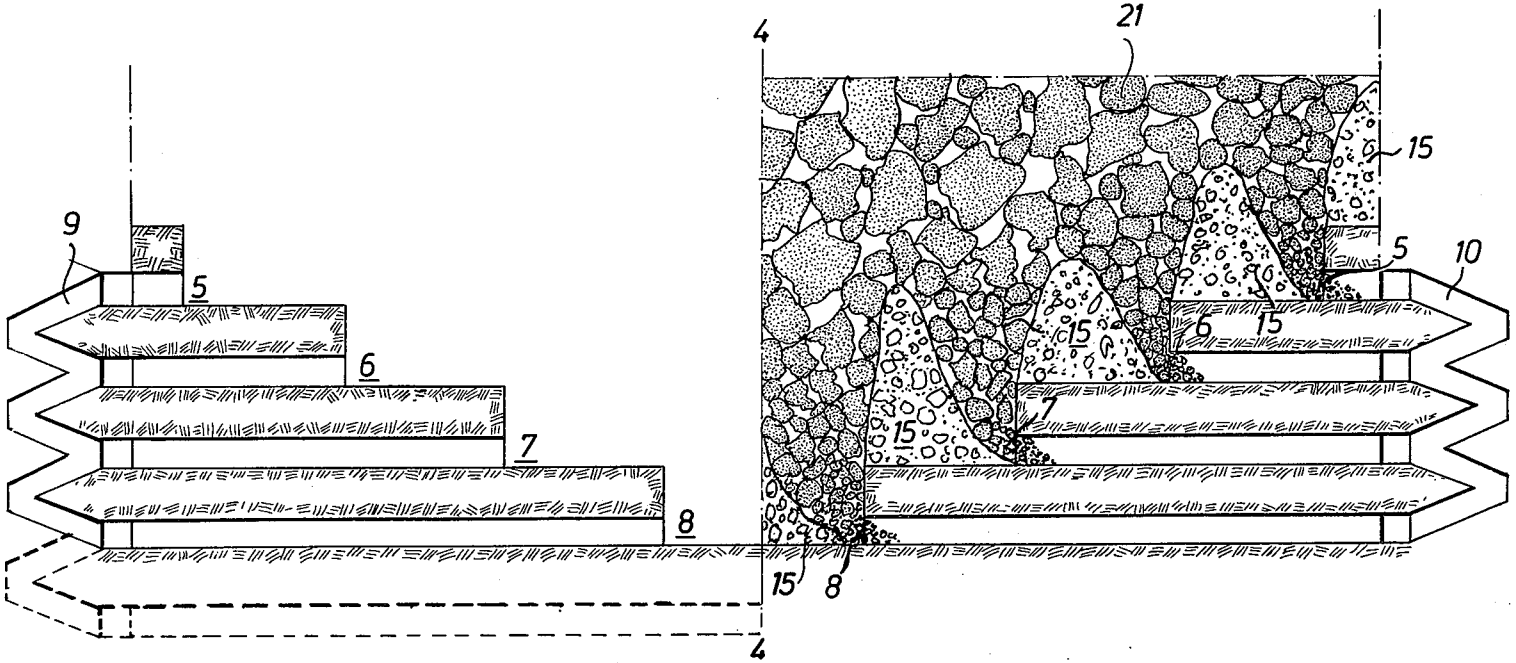
FIGS. 2 and 3 show sections taken along lines II—II and III—III, respectively, in FIG. 1.
Figure 3:
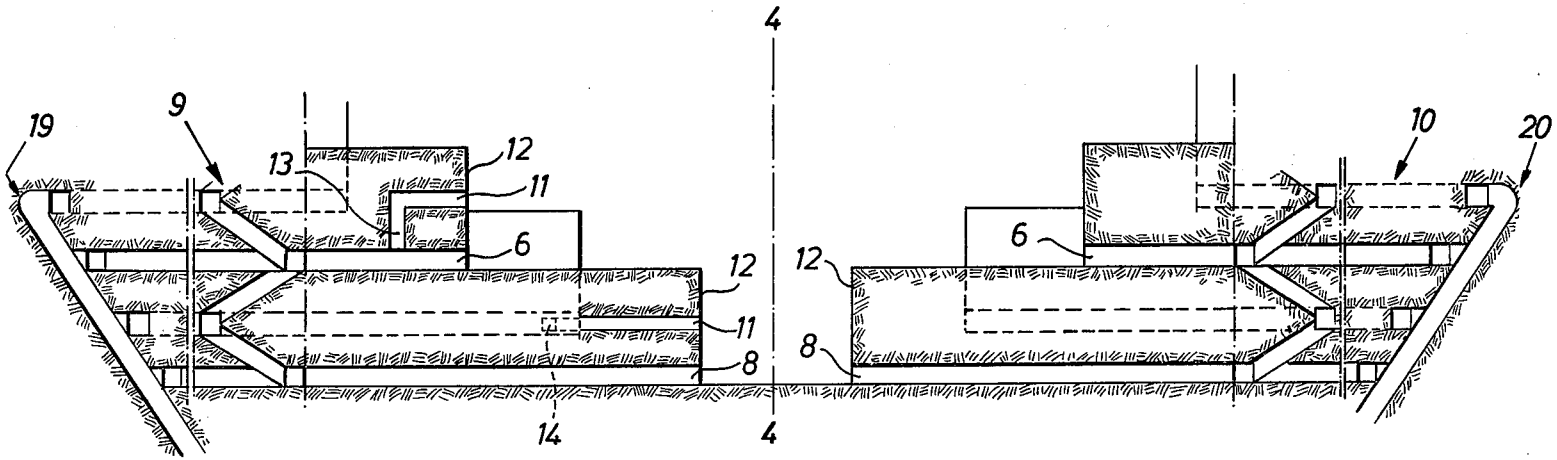

FIG. 1 shows a part of an ore-block with a width of e.g. 115 meters. Its length as is shown in FIGS. 2 and 3 can be e.g. 120 meters. Straight, parallel and horizontal drifts 1 are driven through the block at four levels. The drifts of adjacent levels are located in separate vertical planes.

The drifts 1 in which loading is to take place, are located at a horizontal distance of 15 meters and a vertical distance of 8 meters from each other. The width of the drifts is 5 meters and the height 3 meters. Consequently, the remaining pillars at a certain level cover about 75% or more than 70%, of the total block area. The distance between the drifts can be chosen with regard to the strength and stability of the ore body in which the block is to be mined. The block is undercut from the uppermost level of drifts 1 by blasting in fan-shaped planes 3 against a slot or a raise in the center along section 4. By fan-drilling and blasting as according to the sublevel caving method, the drifts of the uppermost level are retreated to points 5. At underlying levels drilling and blasting is carried out in the same way but stopping at points 6, 7 and 8, respectively. The horizontal distance between these points, e.g. between points 7 and 8 in FIG. 2, can be chosen according to wish (in this case 15 meters), but it has influence on the required number of levels. The caving ore from the undercut block is loaded out at points 5–8, and these points can therefore be said to be draw-points. According to the system described above, the horizontal distance between the draw-points can be varied between very wide limits without reducing stability, which is a great advantage of this invention.

Access to the various drift levels or draw-point levels is obtained e.g. through ramps 9 and 10, respectively, outside the block or at the boundary between two adjoining blocks. (The ramps and dump drifts are only indicated in principle.) Gathering systems or ore dump drifts 19 and 20, respectively, which may be used in connection with the invention, are shows in FIG. 3.

However, it should be noted that there is no need for driving the drifts 1 through the whole block when preparing it for mining. Instead, drifts e.g. according to the pattern shown in FIG. 1 can be driven from opposite sides of the block up to points above 6, 7 and 8 and to centerline 4 in FIG. 2, respectively. That is the top level drifts are driven past point 5 to a position corresponding to draw-points 6 of the adjacent underlying drift level, and so on.

The block can then be undercut by drilling and blasting in towards the block from the said points, while bringing down the covering at the inner part of these drifts, so that a configuration according to FIGS. 2 and 3 is obtained.

A very gret advantage of the described system is that if the drift wall or roof around the draw-point opening of the drift at points 5, 6, 7 or 8 become damaged during loading or due to blasting, the damaged part can be blasted away and the vertical wall at points 5, 6, 7 and 8 retreated e.g. some meters, until a solid wall is restored. In the system applied in known block caving technique, the location of the draw-points must be maintained, which requires extensive and costly reinforcement work. If, in a system according to the present invention, the draw-points must be retreated several times, a new draw-point level may be arranged under the block with draw-points centrally located so that ore-rests under the center of the block can be loaded out. This is indicated in FIG. 2.

For bringing down hangups caused by big boulders and for blasting of boulders above the draw-points, access drifts 11, opening out into the solid rock wall 12, are arranged in the pillars or in the covering of the drifts. These access drifts can be entered either through raises 13 from the adjacent draw-point level or through connecting horizontal drifts 14 from the draw-point level located above.

When loading out the caving ore, substantially stationary ore-piles 15 (see FIG. 2) will be formed on the coverings of the drifts in the undercutting area. The ore-piles 15 will then form parts of the funnel-shaped draw openings up to the caving area. As is shown in FIGS. 2 and 3, the coverings of the drifts and the vertical end walls 12 of the coverings can be said to be arranged in the stepped or terraced configuration which is characteristic of the invention.

Figure 4:
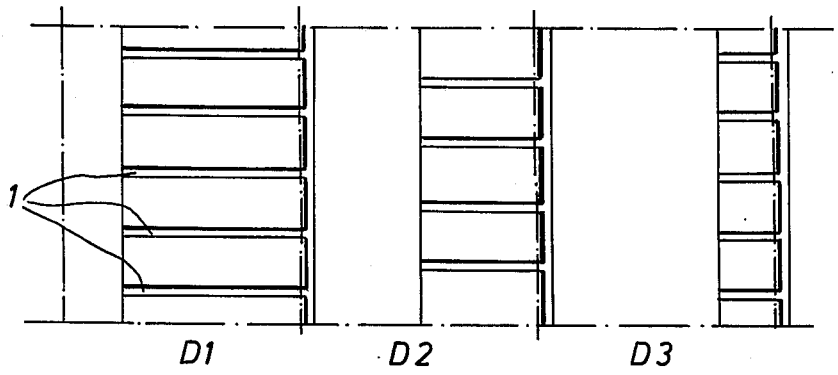
FIGS. 4 and 4A show schematically a horizontal and a vertical view, respectively, of an alternative preparation for mining according to the invention, FIG. 4 being a horizontal section taken along line A—A in FIG. 4A.
Figure 4A:
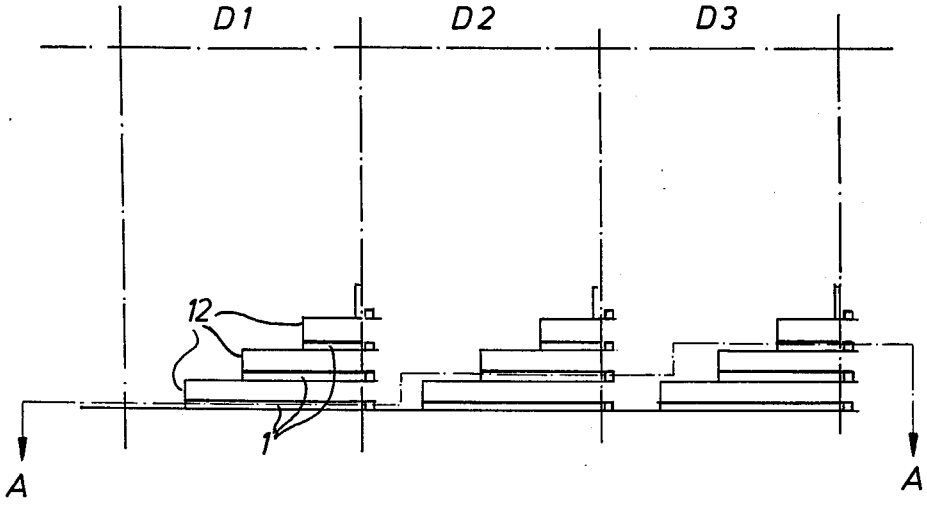

In FIGS. 4 and 4A are shown three blocks D1, D2 and D3 respectively in an orebody. Preparation for mining is here carried out with drifts from only one side of the ore-blocks. This gives the coverings an arrangement in single steps as indicated in FIG. 4A, as distinguished from the arrangement in double steps, shown in FIG. 2. The drifts can be driven longitudinally through the orebody according to the pattern shown in FIG. 1, and then block D1 is undercut along shown step shape. When the ore in block D1 has been loaded out, the same loading drifts may be retreated under block D2 in order to directly start thereby undercutting in step arrangement and loading, and after extraction of all ore in block D2 the drifts may be retreated under block D3 for ore extraction in the same manner etc. With this step-wise shifting, a kind of continuous mining method is achieved.

Of course the arrangement in single steps shown in e.g. block D1 in FIG. 4A, can easily be adapted to an inclined ore face.

FIG. 4 is a horizontal section taken along line A-A in FIG. 4A and shows only the drift extent within the separate blocks. In practice, the drifts of D1 may extend only a short distance into D2, the transport drifts and ramps then being located in D2 close to D1. After block D1 has been mined according to the block caving principle, the resulting lower part of the block may be mined by the sublevel caving principle which can be carried on until the indicated position in block D2 is achieved, whereafter block D2 can be mined by the block caving principle, and so on.

What is claimed is:

1. A method for mining of rock or ore according to the block caving principle, comprising driving, at several levels, substantially straight, parallel and horizontal drifts into the lower part of a block, choosing the distance between the drifts of each level so that remaining supporting pillars will cover at least 40% of the block area, undercutting the block from the drifts in such a way that the drift openings toward the undercut area and the drift coverings will be arranged in a stepped configuration, the drift openings being utilized as draw-points for the caving material, the number of drift levels being chosen with regard to desired horizontal distance along the direction of the drifts between the draw-points at adjacent levels, and further blasting down said drift coverings to retreat the draw-points if cracks and cave-ins occur in the coverings at said drift openings.

2. A method for mining of rock or ore according to the block caving principle, comprising driving, at several levels, substantially straight, parallel and horizontal drifts into the lower part of a blcok, choosing the distance between the drifts of each level so that remaining supporting pillars will cover at least 40% of the block area, undercutting the block from the drifts in such a way that the drift openings toward the undercut area and the drift coverings will be arranged in a stepped configuration, the drift openings being utilized as draw-points for the caving material, the number of drift levels being chosen with regard to desired horizontal distance along the direction of the drifts between the drawpoints at adjacent levels, providing access drifts above said draw-points for taking down hangups formed by large boulders and for secondary blasting of said boulders, and connecting said access drifts to the draw-point drifts via a raise from the adjacent draw-point level or via a horizontal drift from a higher draw-point level.

3. A method for mining of rock or ore according to the block caving principle, comprising driving, at several levels, substantially straight, parallel and horizontal drifts through the entire lower part of a block, choosing the distance between the drifts of each level so that remaining supporting pillars will cover at least 40% of the block area, undercutting the block from the drifts by blasting down the covering and adjoining parts of the drifts at each level so that the drift openings toward the undercut area and the drift coverings will be arranged in a stepped configuration, the drift openings being utilized as draw-points for the caving material, the number of drift levels being chosen with regard to desired horizontal distance along the direction of the drifts between the draw-points at adjacent levels, and further blasting down said drift coverings to retreat the draw-points if cracks and cave-ins occur in the coverings at said drift openings.

4. A method for mining of rock or ore according to the block caving principle, comprising driving, at several levels, substantially straight, parallel and horizontal drifts into the lower part of a block, choosing the distance between the drifts of each level so that remaining supporting pillars will cover at least 40% of the block area, undercutting the block from the drifts from opposite sides of the block so that the drift openings toward the undercut area and the drift coverings will be arranged in a stepped configuration from said opposite sides of the block, the drift openings being utilized as draw-points for the caving material, the lowest draw-point level being located in the lower central part of the block, the number of drift levels being chosen with regard to desired horizontal distance along the direction of the drifts between the draw-points at adjacent levels, and further blasting down said drift coverings to retreat the draw-points if cracks and cave-ins occur in the coverings at said drift openings.

5. A method for mining of rock or ore according to the block caving principle, comprising driving, at several levels, substantially straight, parallel and horizontal drifts through the entire lower part of a block, choosing the distance between the drifts of each level so that remaining supporting pillars will cover at least 40% of the block area, undercutting the block from the drifts by blasting down the covering and adjoining parts of the drifts at each level so that the drift openings toward the undercut area and the drift coverings will be arranged in a stepped configuration, the drift openings being utilized as draw-points for the caving material, the number of drift levels being chosen with regard to desired horizontal distance along the direction of the drifts between the draw-points at adjacent levels, providing access drifts above said draw-points for taking down hangups formed by large boulders and for secondary blasting of said boulders, and connecting said access drifts to the draw-point drifts via a raise from the adjacent draw-point level or via a horizontal drift from a higher draw-point level.

6. A method for mining of rock or ore according to the block caving principle, comprising driving, at several levels, substantially straight, parallel and horizontal drifts into the lower part of a block, choosing the distance between the drifts of each level so that remaining supporting pillars will cover at least 40% of the block area, undercutting the block from the drifts from opposite sides of the block so that the drift openings toward the undercut area and the drift coverings will be arranged in a stepped configuration, the drift openings being utilized as draw-points for the caving material, the lowest draw-point level being located in the lower central part of the block, the number of drift levels being chosen with regard to desired horizontal distance along the direction of the drifts between the draw-points at adjacent levels, providing access drifts above said draw-points for taking down hangups formed by large boulders and for secondary blasting of said boulders, and connecting said access drifts to the draw-point drifts via a raise from the adjacent draw-point level or via a horizontal drift from a higher draw-point level.

7. A method for mining of rock or ore according to the block caving principle from a long ore or rock mass, said mass comprising a plurality of adjoining blocks, said method comprising longitudinally driving, at several levels, substantially straight, parallel and horizontal drifts into the lower parts of a plurality of adjoining blocks choosing the distance between the drifts of each level so that remaining supporting pillars will cover at least 40% of the area of said blocks, undercutting the blocks of said mass from the drifts in such a way that the drift openings toward the undercut area and the drift coverings will be arranged in a stepped configuration, the drift openings being utilized as draw-points for the caving material, the number of drift levels being chosen with regard to desired horizontal distance along the direction of the drifts between the draw-points at adjacent levels, providing access drifts above said draw-points for taking down hangups formed by large boulders and for secondary blasting of said boulders, and connecting said access drifts to the draw-point drifts via a raise from the adjacent draw-point level or via a horizontal drift from a higher draw-point level.

* * * * *